US008646517B2

(12) United States Patent
Blomgren

(10) Patent No.: US 8,646,517 B2
(45) Date of Patent: Feb. 11, 2014

(54) PLATE AND GASKET FOR PLATE HEAT EXCHANGER

(75) Inventor: Ralf Blomgren, Skanor (SE)

(73) Assignee: Alfa Laval Corporate AB, Lund (SE)

( * ) Notice: Subject to any disclaimer, the term of this patent is extended or adjusted under 35 U.S.C. 154(b) by 1108 days.

(21) Appl. No.: 12/303,150

(22) PCT Filed: May 11, 2007

(86) PCT No.: PCT/SE2007/050328

§ 371 (c)(1),
(2), (4) Date: Jan. 20, 2009

(87) PCT Pub. No.: WO2007/142592

PCT Pub. Date: Dec. 13, 2007

(65) Prior Publication Data

US 2009/0159251 A1 Jun. 25, 2009

(30) Foreign Application Priority Data

Jun. 5, 2006 (SE) ..... 0601259

(51) Int. Cl.
*F28F 3/08* (2006.01)

(52) U.S. Cl.
USPC ..... 165/167

(58) Field of Classification Search
USPC ..... 165/167
See application file for complete search history.

(56) References Cited

U.S. PATENT DOCUMENTS 2,705,617 A * 4/1955 Ekwall ..... 165/181
5,443,115 A * 8/1995 Pedersen et al. ..... 165/70
5,522,462 A * 6/1996 Kumar et al. ..... 165/166
7,424,908 B2 * 9/2008 Blomgren ..... 165/167
2006/0048927 A1 * 3/2006 Blomgren ..... 165/167
2008/0196873 A1 * 8/2008 Svensson ..... 165/167

FOREIGN PATENT DOCUMENTS

| | | | |
|---|---|---|---|
| DE | 25 52 335 | A1 | 6/1977 |
| DE | 197 03 729 | C1 | 7/1998 |
| GB | 1459619 | | 12/1976 |
| JP | 5-264193 | A | 10/1993 |
| NL | 71993 | | 2/1953 |
| RU | 2 008 602 | | 2/1994 |
| RU | 37 196 | U1 | 4/2004 |
| WO | WO 2004/011868 | A1 | 2/2004 |
| WO | WO 2004072570 | A1 * | 8/2004 |

OTHER PUBLICATIONS

Int'l Search Report.
PCT/ISA/237.

(Continued)

*Primary Examiner* — Brandon M Rosati
(74) *Attorney, Agent, or Firm* — Buchanan Ingersoll & Rooney PC

(57) ABSTRACT

The invention relates to a heat exchanger plate for a plate heat exchanger, which plate has a number of ports, a distribution region, a heat transfer region, a first adiabatic region, a second adiabatic region and an edge area that extends outside the ports and the regions, which plate has a first gasket groove extending in the edge area outside the regions and around the ports, and a second gasket groove extending between the adiabatic region and the adjacent distribution region, whereby the gasket grooves are connected together to accommodate a gasket for sealing abutment against an adjacent heat exchanger plate in the plate heat exchanger. The invention further relates to a gasket for a heat exchanger plate and a plate heat exchanger having a package of heat exchanger plates and gaskets.

12 Claims, 4 Drawing Sheets

(56) References Cited

OTHER PUBLICATIONS

Russian Office Action issued on Mar. 22, 2011 by Russian Patent Office in corresponding Russian Patent Application No. 2008152743, and partial English translation thereof.

European Search Report issued on Dec. 13, 2013 by European Patent Office in corresponding European Patent Application No. 07748489.7.

* cited by examiner

PLATE AND GASKET FOR PLATE HEAT EXCHANGER

FIELD OF THE INVENTION

The present invention relates to a heat exchanger plate for a plate heat exchanger according to the preamble of claim 1. The invention also relates to a gasket for the heat exchanger plate and a plate heat exchanger comprising the heat exchanger plate and the gasket according to the invention.

STATE OF THE ART

Plate heat exchangers provided with gaskets normally comprise a package of heat exchanger plates disposed adjacent to one another. Gaskets are disposed between the heat exchanger plates, or the plates are permanently joined together, e.g. by soldering. The plates may also be permanently joined together in pairs to form so-called cassettes, e.g. by welding, with gaskets placed between the respective cassettes. The gaskets are accommodated in gasket grooves formed during the form-pressing of the heat exchanger plates. Plate heat exchangers further comprise inlet and outlet ports, which extend through the plate package, for two or more media.

Heat exchanger plates are normally made by form-pressing of sheetmetal and are disposed in the plate package in such a way as to form first plate intermediate spaces which communicate with the first inlet port and the first outlet port, and second plate intermediate spaces which communicate with the second inlet port and the second outlet port. The first and second plate intermediate spaces are disposed alternately in the plate package.

The design of plates for plate heat exchangers has to cater for plate edge retraction during pressing. The pressing method used is called tensile pressing and the plate material is stretched to form patterns in the plate. As there is no greater force at the plate edge to resist and prevent retraction of the material than the friction which occurs between the tool and the plate, the greatest retraction will be at the plate edge. The amount of retraction may depend on a number of factors such as material quality, plate thickness, tool material, lubrication, pressing depth and pattern created.

The plate pattern may vary depending on the intended purpose of the region or surface, i.e. whether it is a liquid distribution region, a heat transfer region, an adiabatic region, etc. The pattern within the plate edge will therefore vary along the long sides of the plate, which means that the retraction which occurs during pressing will also vary along the plate edges. The greatest retraction occurs where the pattern comprises long ridges and valleys running parallel with the plate edge. This configuration occurs inter alia on the adiabatic regions where the purpose of the pattern is to allow the flow to pass with the least possible resistance, since no heat exchange takes place in those regions. Thus the magnitude of this retraction is at present crucial for the positioning of the gasket groove along the whole long side of the plate. This results in the gasket groove being positioned further from the edge along the heat transfer region than is really necessary. The reason is that the retraction along the heat transfer region is normally uneven because the pattern usually involves ridges and valleys constituting a fishbone pattern which forms angles relative to the longitudinal direction of the plate edge, so such a pattern better counteracts retraction during pressing. A consequent disadvantage is that the heat transfer region of the plate has to be made smaller than it would be if the gasket groove was instead positioned relative to the retraction along the heat transfer region, since that retraction is smaller. The capacity of the plate thus becomes smaller and more plates have to be used to achieve a certain plate heat exchanger performance.

SUMMARY OF THE INVENTION

The object of the invention is to prevent or at least reduce the disadvantages indicated above and provide a better solution for a heat exchanger plate which comprises a gasket and a gasket groove. Particular aims are a new and better heat exchanger plate and a gasket which enables optimum utilisation of the plate's heat transfer region and thereby results in better plate heat exchanger performance with a given number of plates.

This object is achieved according to the invention by the heat exchanger plate for a plate heat exchanger as indicated in the introduction which is characterised by the gasket groove in a first section along the adiabatic region being positioned at a distance from a centreline in the longitudinal direction of the heat exchanger plate which is less than the distance from the gasket groove in a second section along the heat transfer region to the heat exchanger plate centreline.

The invention makes it possible to provide a heat exchanger plate where a larger proportion of the plate's surface can be utilised for heat transfer.

According to an embodiment of the invention, the gasket groove, at an end of the first section which points towards the heat transfer region, connects to the second gasket groove at a point which divides the second gasket groove into a first section extending between the centreline and the point, and a second section extending between the point and the gasket groove at an end of the second section.

According to a further embodiment of the invention, two heat exchanger plates are permanently joined together as a pair to form a cassette. With advantage, the cassettes are joined together by welding. Gaskets are disposed with advantage between the cassettes.

The object of the invention is also achieved by the gasket indicated in the introduction which is characterised in that it comprises a first gasket part accommodated in the first gasket groove and a second gasket part accommodated in the second gasket groove, whereby the first gasket part in a first section along the adiabatic region extends at a distance from a centreline in the longitudinal direction of the heat exchanger plate which is less than the distance from the first gasket part in a second section along the heat transfer region to the heat exchanger plate centreline.

According to an embodiment of the invention, the first gasket part, at an end of the first section which points towards the heat transfer region, connects to the second gasket part at a point which divides the gasket part into a first section extending between the centreline and the point, and a second section extending between the point and the gasket groove at an end of the second section.

According to a further embodiment of the invention, the first gasket part in the first section comprises recesses for detection of leakage. The gasket is with advantage made of a rubber or polymer material.

A further object of the invention is achieved with a heat exchanger which comprises a heat exchanger plate and a gasket according to the invention.

The invention makes it possible to produce a heat exchanger of increased performance. The number of plates can be reduced while maintaining the same capacity, resulting in cost savings on both material and space. Since many applications, e.g. those for aggressive media, involve very expensive material, the heat transfer capacity and hence the number of heat exchanger plates are of crucial cost significance. It is not unusual for a plate heat exchanger to comprise up to a thousand heat exchanger plates, which means that even a seemingly slight capacity improvement of a heat exchanger plate and a plate heat exchanger according to the invention may have a very large impact on profitability.

BRIEF DESCRIPTION OF THE DRAWINGS

The invention is explained in more detail below by describing various examples of embodiments with reference to the attached drawings.

DETAILED DESCRIPTION OF VARIOUS EMBODIMENTS OF THE INVENTION

Figure 1:
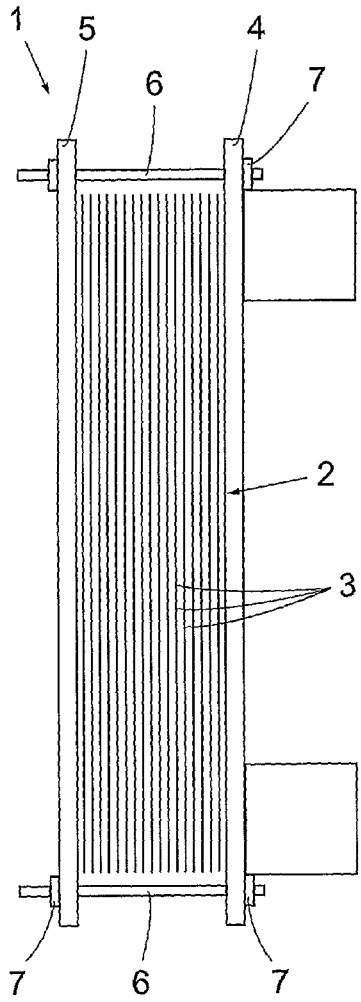
FIG. 1 depicts schematically a sideview of a plate heat exchanger.
Figure 2:
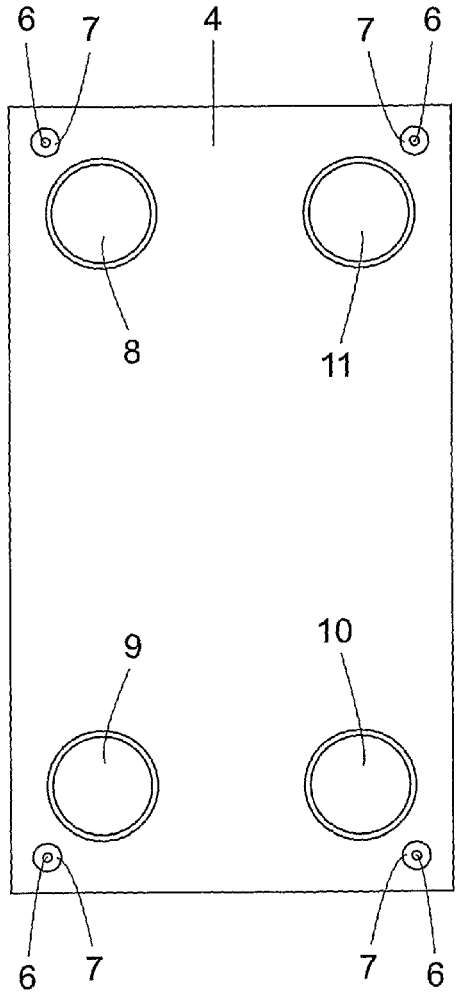
FIG. 2 depicts schematically a plan view of the plate heat exchanger in FIG. 1.

FIGS. 1 and 2 depict a plate heat exchanger 1 comprising a plate package 2 with heat exchanger plates 3 disposed adjacent to one another. The plate package 2 is disposed between two end-plates 4 and 5 which may constitute a frame plate and a pressure plate respectively. The end-plates 4 and 5 are pressed against the plate package 2 and against one another by drawbolts 6 which extend through the end-plates 4 and 5. The drawbolts 6 have screw threads and the plate package 2 can therefore be compressed by nuts 7 being tightened on the drawbolts 6. The number of drawbolts 6 may of course vary and be different in different applications.

The plate heat exchanger 1 comprises in the embodiment depicted a first inlet port 8 and a first outlet port 9 for a first medium, and a second inlet port 10 and a second outlet port 11 for a second medium. The inlet and outlet ports 8-11 extend through the one end-plate 4 and the plate package 2. It is of course also possible for the inlet and outlet ports to be disposed on both sides of the plate heat exchanger.

Figure 3:
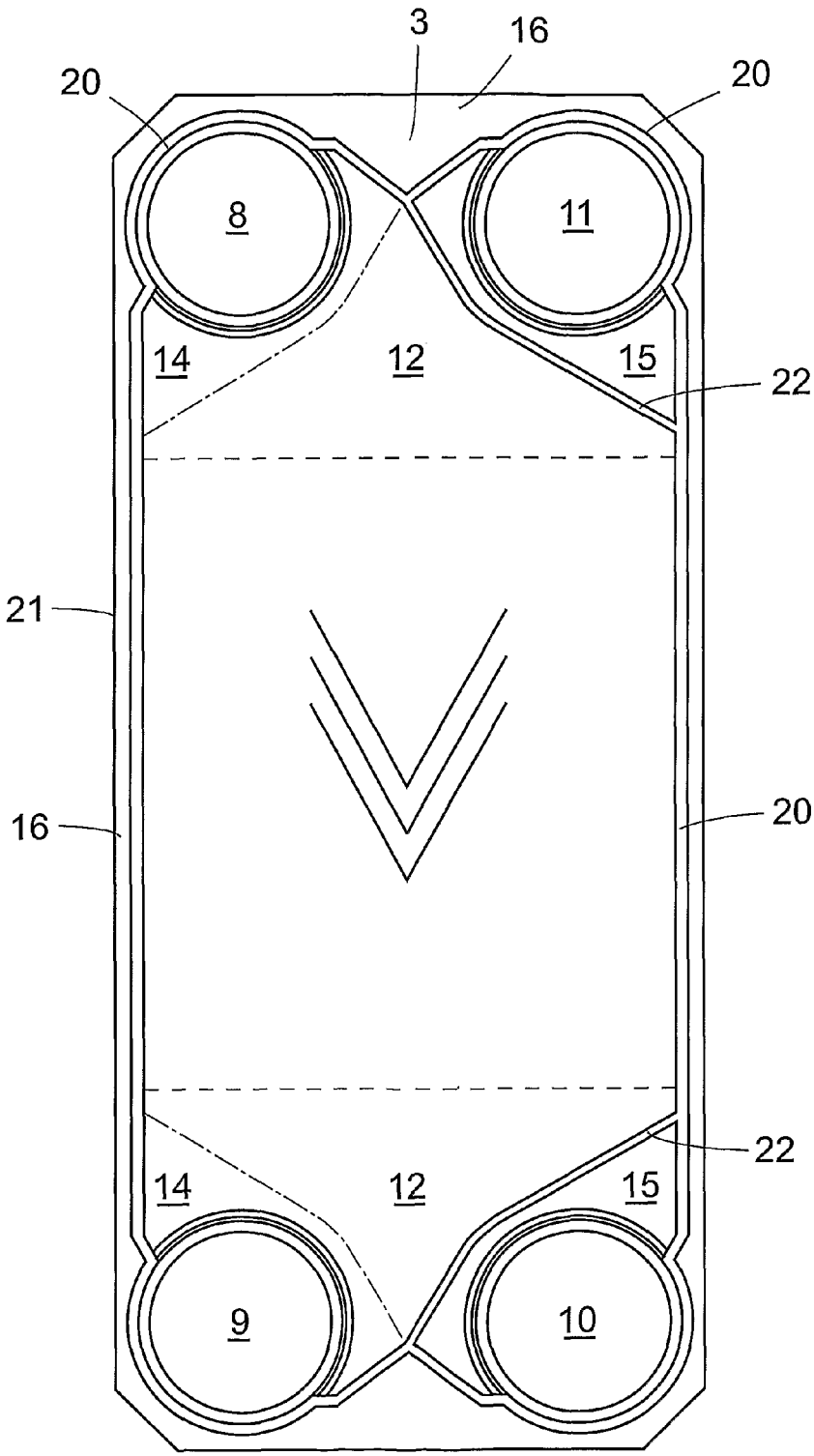
FIG. 3 depicts schematically a heat exchanger plate of the plate heat exchanger in FIG. 1.

FIG. 3 depicts a heat exchanger plate 3 made of form-pressed sheetmetal, e.g. stainless steel, titanium or some other material suitable for the application. The heat exchanger plate 3 further comprises upper and lower distribution regions 12 and, between them, a heat transfer region 13. A first so-called adiabatic region 14 is disposed at the ports 8 and 9, and a second adiabatic region 15 at the ports 10 and 11. There is an edge region 16 outside and round the ports 8-11 and the regions 12, 13, 14 and 15.

The heat exchanger plate 3 has in the embodiment depicted four ports 8-11 extending through the heat exchanger plate 3 and situated within and in the vicinity of the edge region 16. The ports 8-11 are normally each situated in the vicinity of their respective corner portion of the heat exchanger plate 3, but other positioning of the ports 8-11 may also arise within the scope of the invention.

Figure 4:
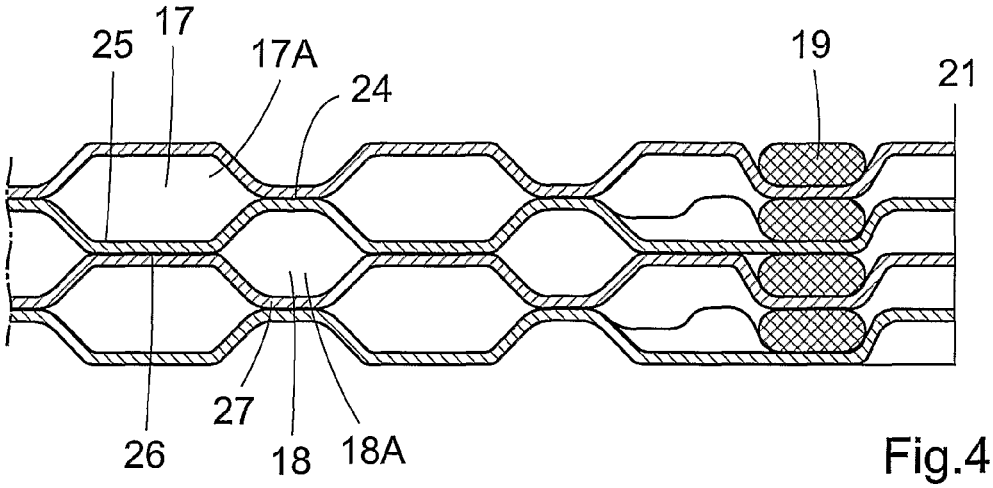
FIG. 4 depicts schematically a section through a plate package of a plate heat exchanger according to the invention along the line I-I.

The heat exchanger plates 3 are disposed in such a way in the plate package 2 as to form first plate intermediate spaces 17 which communicate with the first inlet port 8 and the first outlet port 9, and second plate intermediate spaces 18 which communicate with the second inlet port 10 and the second outlet port 11, see FIG. 4. The first and second plate intermediate spaces 17 and 18 are disposed alternately in the plate package 2. The separation of the plate intermediate spaces 17 and 18 may be by gaskets 19 extending in gasket grooves formed during the form-pressing of the heat exchanger plates 3.

The gasket groove of a heat exchanger plate 3 is depicted in FIG. 3 and comprises a first gasket groove 20 extending in the edge region 16 along the plate edge 21 round the heat transfer region 13, the distribution region 12, the first and second adiabatic regions 14, 15 and round the ports 8-11. A second gasket groove 22 extends diagonally between the second adiabatic region 15 and the adjacent distribution region 12, as may be seen in FIG. 3. To make it possible to utilise the maximum possible amount of the heat transfer region 13, it is desirable to be able to position the gasket groove 20 as near as possible to the plate edge 21. A limiting factor, however, is that the edge region 16 has for strength reasons to be provided with a wavelike corrugation pattern with ridges and valleys which form a number of so-called nibs which occupy a certain minimum surface of the edge region 16. There has therefore to be at least a certain minimum distance between the plate edge 21 and the gasket groove 20.

All of said regions 12-15 are provided with a corrugation of ridges and valleys. The pattern of each region may vary depending on its particular purpose, i.e. whether it is a distribution region 12, a heat transfer region 13 or an adiabatic region 14, 15.

The purpose of the distribution regions 12 is to distribute the liquid evenly over the width of the plate while causing as little flow resistance as possible. Various patterns may be used for this region, and in the example depicted the distribution regions 12 are provided with a so-called chocolate pattern which is described inter alia in GB-A 1 357 282.

The heat transfer region 13 in the example depicted is provided with a conventional so-called fishbone pattern of ridges and valleys which in the plate package 2 form angles between mutually intersecting ridges and valleys of plates situated adjacent to one another to provide maximum possible heat transfer.

The adiabatic regions 14, 15 situated between the ports 8-11 and the distribution regions 12 have different purposes depending on whether they are on the side 14 where the medium flows or on the side 15 which is sealed off, the so-called leakage space. The purpose of the adiabatic region 14 is to transfer the liquid between the ports 8, 9 and the distribution region 12 with the least possible resistance, since no heat exchange takes place in the adiabatic region. The purpose of the adiabatic region 15 is to serve as a leakage space, which means that leakage of liquid past the gasket 19 which delineates the adiabatic region 15 accumulates in the leakage space and leaves the plate heat exchanger 1 via leakage grooves 23 in the gasket 19, see FIG. 5. This makes it easy to detect any leakage, which will be clearly visible from the outside of the heat exchanger.

The corrugation pattern in the adiabatic region 14 comprises ridges 24 and valleys 25, see FIG. 4, which run largely parallel with the plate outer edge 21. The fact that the width of the bottom plane of the valleys 25 is larger than the top plane of the ridges 24 results, when two plates 3 are placed in abutment against one another, in a larger volume in the ducts 17A in the plate intermediate spaces 17 which are filled with medium in the adiabatic region 14. The adiabatic region 15 constituting the leakage space has ridges 26 and valleys 27. The width of the bottom plane of the valleys 27 is smaller than the top plane of the ridges 26, resulting, when two plates 3 are placed in abutment against one another, in the formation of ducts 18A in the plate intermediate spaces 18 with a smaller volume than that of the ducts 17A in the plate intermediate spaces 17, which ducts 18A serve to remove any leakage which passes the gasket 19.

Figure 5:
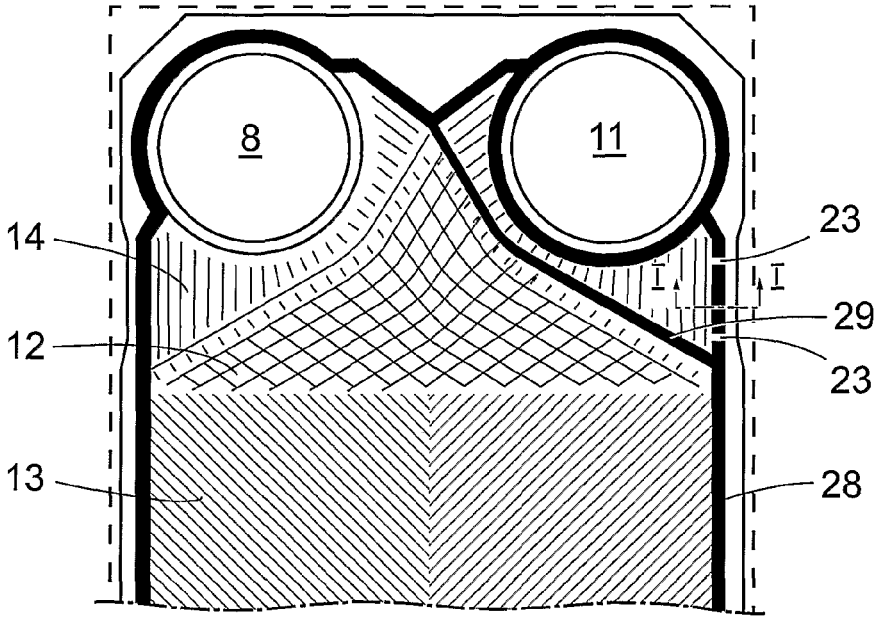
FIG. 5 depicts schematically a heat exchanger plate of the plate heat exchanger in FIG. 1 with gasket applied.
Figure 6:
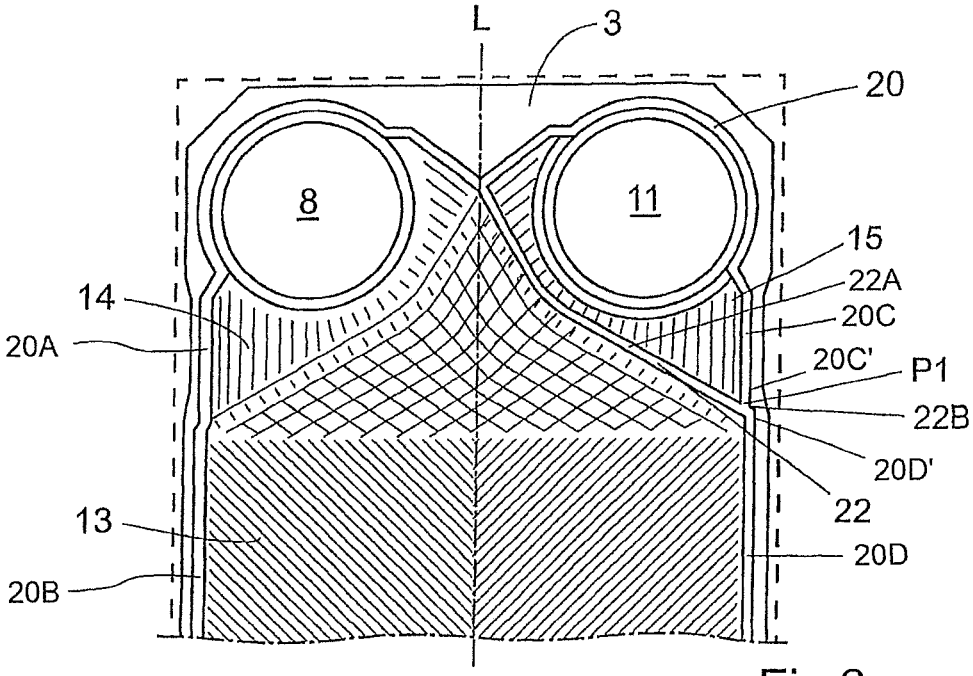
FIG. 6 depicts schematically a heat exchanger plate according to the invention.
Figure 7:
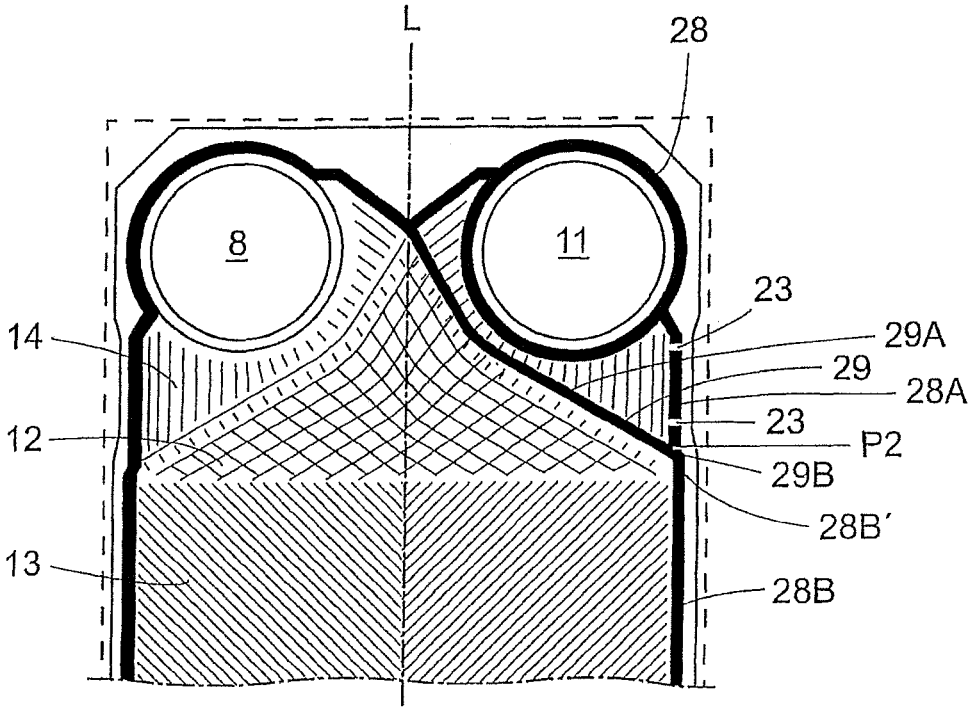
FIG. 7 depicts schematically a heat exchanger plate according to the invention with gasket applied.

As mentioned above, the pattern situated within the edge 21 will vary along the long sides of the plate 3, which means that the retraction which occurs during pressing will also vary along the plate edges, see FIGS. 5, 6 and 7. The magnitude of the retraction may depend on a number of factors such as material quality, plate thickness, tool material, lubrication, pressing depth and pattern created. The greatest retraction occurs in the adiabatic regions 14 and 15 where the pattern comprises ridges 24, 26 and valleys 25, 27 which form long members extending parallel with the plate edge 21. The cross-weave pattern or fishbone pattern in the heat transfer region 13 and the chocolate pattern in the distribution regions 12 do not result in such great retractions, since these patterns have a greater ability to counteract retraction than the corrugation pattern in the adiabatic regions 14, 15 which runs largely parallel with the heat exchanger plate edge 21. During the forming of the plate, it is mainly the friction in the adiabatic regions 14, 15 which occurs between the tool and the plate that counteracts the retraction of the sheetmetal.

FIG. 6 shows that the first gasket groove 20 includes a first portion 20A bordering the first adiabatic region 14, a second portion 20B bordering the heat transfer region 13, a third portion 20C bordering the second adiabatic region 15, and a fourth portion 20D bordering the heat transfer region 13.

FIG. 6 shows that the first gasket groove 20 includes a first portion 20A bordering the first adiabatic region 14, a second portion 20B bordering the heat transfer region 13, a third portion 20C bordering the second adiabatic region 15 and a fourth portion 20D bordering the heat transfer region 13. To ensure that catering for the magnitude of the retraction in the adiabatic regions 14, 15 does not make it crucial for the first gasket 20 groove to be positioned along the whole of the plate's long side and for the first gasket groove 20 to be therefore positioned unnecessarily far from the edge 21 along the heat transfer region 13 where the retraction is not as great, the invention positions the third portion 20C of the first gasket groove 20 along the second adiabatic region 15 at a distance from a centreline L in the longitudinal direction of the heat exchanger plate 3 which is less than the distance from the fourth portion 20D of the first gasket groove 20 along the heat transfer region 13 to the heat exchanger plate centreline L, as may be seen in FIG. 6.

According to a second embodiment of the invention, the first gasket groove 20, at the end 20C' of the third portion 20C which points towards the heat transfer region 13, connects to the second gasket groove 22 at a point P1 which divides the second gasket groove 22 into a first section 22A extending between the centreline L and the point P1, and a second section 22B extending between the point P1 and the first gasket groove 20 at an end 20D' of the fourth portion 20D.

Positioning the first gasket groove 20 at the third portion 20C along the second adiabatic region 15 somewhat further in on the heat exchanger plate 3, nearer to the centreline L, makes it possible to cater for the fact that there will be greater retraction of the heat exchanger plate along this edge section. The advantage is that the plate's heat transfer region 13 can be made larger than it would be if the first gasket groove 20 at the fourth portion 20D was instead positioned in relation to the retraction along the adiabatic region 15 at the same distance from the centreline L as the third portion 20C of the first gasket groove 20. The capacity of the plate 3 and the plate heat exchanger 1 will thus be greater and fewer plates need be used for achieving desired performance. The result is a great saving of material costs.

In a third embodiment of the invention, two heat exchanger plates 3 are joined together permanently as a pair to form a cassette, e.g. by welding. Gaskets 19 are with advantage disposed between adjacent cassettes.

As mentioned above, gaskets 19 are fitted between two adjacent heat exchanger plates 3, or between two cassettes, before assembling the plate heat exchanger 1, and the shape of the gasket 19 corresponds in principle to the shape and extent of the gasket grooves 20, 22, as may be seen in FIGS. 5 and 7. The gasket is usually made of a rubber or polymer material.

According to a first embodiment of the gasket 19 according to the invention, it comprises a first gasket part 28 to be accommodated in the gasket groove 20 and a second gasket part 29 to be accommodated in the gasket groove 22. The gasket part 28 extends in a section 28*a* along the adiabatic region 15 at a distance from a centreline L in the longitudinal direction of the heat exchanger plate 3 which is less than the distance from the first gasket part 28 in a section 28B along the heat transfer region 13 to the heat exchanger plate centreline L.

According to another embodiment, the gasket part 28, at an end 28A' of the section 28A which points towards the heat transfer region 13, connects to the second gasket part 29 at a point P2 which divides the gasket part 29 into a first section 29A extending between the centreline L and the point P2, and a second section 29B extending between the point P2 and the gasket groove 28 at an end 28B' of the section 28B.

To be able to transfer leaking medium from the heat transfer region 13 via the adiabatic region 15 to the outside of the heat exchanger 1 and hence detect leakage, the gasket according to a further embodiment is provided with recesses 23 in the gasket part 28 in the section 28A along the adiabatic region 15.

A plate heat exchanger 1 according to the invention comprises a package 2 of heat exchanger plates 3 and gaskets 19 according to the invention. During the assembly of the plate heat exchanger 1 in the example depicted, every second heat exchanger plate 3 is rotated 180° about an axis perpendicular to the plane of the plate. Thereafter the heat exchanger plates 3 with associated gaskets 19 are compressed to create the desired first and second plate intermediate spaces 17, 18. In the plate package 2, the first medium may enter through the first inlet port 8, pass through the first plate intermediate spaces 17 and leave via the first outlet port 9. The second medium may enter via the second inlet port 10, pass through the second plate intermediate spaces 18 and leave via the second outlet port 11. The two media may be led in the same or in opposite directions relative to one another.

As the gasket part 29 has no counterpart on the adjacent plate in the plate package, there is risk of this part of the gasket tending to slip. The extra support provided by the gasket part 28A where it connects to the gasket part 29 at the end 28A' at the point P2 reduces the risk of slippage and consequent leakage at the gasket according to the invention.

It should be noted that other embodiments of the invention which are not here referred to are also possible without departing from the invention's scope indicated in the attached claims.

The invention claimed is:

1. A heat exchanger plate for a plate heat exchanger, wherein the plate comprises:

first and second ports positioned on opposite sides of a longitudinal centerline of the heat exchanger plate;

a plurality of regions, including a distribution region, a heat transfer region, and adiabatic regions comprising a first adiabatic region and a second adiabatic region;

an edge area that extends outside the ports and the regions;

a first gasket groove extending in the edge area outside the regions and around the ports, wherein a first portion of the first gasket groove: (i) borders an entire edge of the first adiabatic region positioned farthest from the longitudinal centerline, and (ii) is nearer to the longitudinal centerline than an entirety of a second portion of the first gasket groove bordering the heat transfer region; and a second gasket groove positioned between the second adiabatic region and the distribution region, wherein the first gasket groove and the second gasket groove are connected together to accommodate a gasket for sealing abutment against an adjacent heat exchanger plate in the plate heat exchanger.

2. A heat exchanger plate according to claim 1, wherein a third portion of the first gasket groove bordering the second adiabatic region and substantially parallel to the longitudinal centerline of the plate, connects to the second gasket groove at a point which divides the second gasket groove into a first section extending between the longitudinal centerline and the point, and a second section extending between the point and a fourth portion of the first gasket groove bordering the heat transfer region.

3. Heat exchanger plates according to claim 1, wherein two heat exchanger plates are permanently joined together as a pair to form a cassette.

4. Heat exchanger plates according to claim 3, wherein a pair of adjacent cassettes has gaskets disposed between them for sealing abutment against one another in the plate heat exchanger.

5. Heat exchanger plates according to claim 3, wherein the heat exchanger plates are joined together in pairs by welding to form the cassettes.

6. A gasket in combination with a heat exchanger plate according to claim 1, the gasket comprising a first gasket part accommodated in the first gasket groove, and a second gasket part accommodated in the second gasket groove, wherein the first gasket part in the first portion of the first gasket groove along the first adiabatic region extends at a distance from a centerline in the longitudinal direction of the heat exchanger plate which is less than the distance from the first gasket part in the second portion of the first gasket groove along the heat transfer region to the heat exchanger plate centerline.

7. The gasket in combination with the heat exchanger plate according to claim 6, wherein the first gasket part, at an end of the first portion of the first gasket groove which points towards the heat transfer region, connects to the second gasket part at a point which divides the second gasket part into a first section extending between the centerline and the point, and a second section extending between the point and an end of the second portion of the first gasket groove.

8. The gasket in combination with the heat exchanger plate according to claim 6, wherein the first gasket part in the first portion of the first gasket groove comprises recesses for detection of leakage.

9. The gasket in combination with the heat exchanger plate according to claim 6, wherein the gasket is made of a rubber or polymer material.

10. A plate heat exchanger comprising a package of heat exchanger plates and gaskets according to claim 1.

11. A heat exchanger plate for a plate heat exchanger, the heat exchanger plate comprising:

a first port hole and a second port hole extending through the heat exchanger plate;

a first adiabatic region bordering the first port hole and including a plurality of ridges and valleys configured to direct fluid from the first port hole in a longitudinal direction of the heat exchanger plate;

a second adiabatic region bordering the second port hole and including a plurality of ridges and valleys configured to direct fluid from the second port hole in the longitudinal direction of the heat exchanger plate;

a heat transfer region;

a distribution region surrounded by the first and second adiabatic regions and the heat transfer region, the distribution region including a plurality of ridges and valleys configured to direct fluid from the first adiabatic region to the heat transfer region;

a first gasket groove including a third portion extending along the second adiabatic region and a fourth portion extending along the heat transfer region;

a second gasket groove positioned between the second adiabatic region and the distribution region, the second gasket groove intersecting the third portion of the first gasket groove and the fourth portion of the first gasket groove; and the third portion of the first gasket groove being positioned closer to a centerline of the heat exchanger plate extending in the longitudinal direction than an entirety of the fourth portion of the first gasket groove so that the intersection of the third portion of the first gasket groove and the second gasket groove is closer to the longitudinal centerline than the intersection of the fourth portion of the first gasket groove and the second gasket groove.

12. A heat exchanger plate for a plate heat exchanger, the heat exchanger plate comprising:

first and second ports positioned on opposite sides of a longitudinal centerline of the heat exchanger plate;

a plurality of regions, including a distribution region, a heat transfer region, a first adiabatic region and a second adiabatic region;

an edge area bordering the first and second ports, the distribution region, the heat transfer region, the first adiabatic region and the second adiabatic region;

a first gasket groove positioned in the edge area;

the first gasket groove including first and third portions positioned on opposite sides of the longitudinal centerline and respectively bordering the first and second adiabatic regions;

the first gasket groove including second and fourth portions bordering the heat transfer region on opposite sides of the longitudinal centerline;

the first portion of the first gasket groove being closer to the longitudinal centerline than an entirety of the second portion of the first gasket groove, and the third portion of the first gasket groove being closer to the longitudinal centerline than an entirety of the fourth portion of the first gasket groove;

a second gasket groove connected to the first gasket groove and positioned between the second adiabatic region and the distribution region; and wherein the first gasket groove and the second gasket groove are configured to accommodate a gasket for sealingly engaging an adjacent heat exchanger plate in the plate heat exchanger.

* * * * *